US005826354A

United States Patent [19]

Garbujo

[11] Patent Number: 5,826,354

[45] Date of Patent: Oct. 27, 1998

[54] BOOT WITH CLOSURE BY TRANSVERSE FLAPS

[75] Inventor: Guiseppe Garbujo, Montebelluna, Italy

[73] Assignee: Salomon S.A., Metz-Tessy, France

[21] Appl. No.: 847,496

[22] Filed: Apr. 25, 1997

[30] Foreign Application Priority Data

Apr. 26, 1996 [FR] France ..... 96 05479

[51] Int. Cl.[6] ..... A43B 5/04

[52] U.S. Cl. ..... 36/117.1; 36/50.5; 36/54

[58] Field of Search ..... 36/117.1, 50.5, 36/54

[56] References Cited

U.S. PATENT DOCUMENTS

| | | | |
|---|---|---|---|
| 4,788,782 | 12/1988 | Pozzebon et al. . | |
| 4,974,346 | 12/1990 | Marega et al. | 36/117 |
| 5,054,214 | 10/1991 | Sartor | 36/119 |
| 5,228,219 | 7/1993 | Tonel | 36/117 |
| 5,279,052 | 1/1994 | Perotto et al. . | |
| 5,295,316 | 3/1994 | Bergamin | 36/118 |
| 5,365,679 | 11/1994 | Chemello . | |
| 5,491,910 | 2/1996 | Zorzi . | |
| 5,611,154 | 3/1997 | Luchetta et al. . | |

FOREIGN PATENT DOCUMENTS

| | | |
|---|---|---|
| 0353532 | 2/1990 | European Pat. Off. . |
| 578610 | 1/1994 | European Pat. Off. . |
| 0659358 | 6/1995 | European Pat. Off. . |
| 2129074 | 10/1972 | France . |
| 2651648 | 3/1991 | France . |
| 1915442 | 10/1970 | Germany . |
| 2446066 | 4/1976 | Germany . |
| 575969 | 4/1958 | Italy . |
| 1039942 | 12/1979 | Italy . |
| 207176 | 12/1987 | Italy . |
| 3-17685 | 1/1991 | Japan . |

*Primary Examiner*—Ted Kavanaugh
*Attorney, Agent, or Firm*—Greenblum & Bernstein P.L.C.

[57] ABSTRACT

The invention relates to a sport boot including an upper and a shell base, which boot closes and opens on the top of the foot by means of transverse flaps that partially overlap one another. The slits separate the flaps from the lateral vertical extensions coming from the shell base in the ankle zone by determining two tongues and the edges of a U-shaped scallop in the front portion of the shell base.

9 Claims, 3 Drawing Sheets

BOOT WITH CLOSURE BY TRANSVERSE FLAPS

BACKGROUND OF THE INVENTION

1. Field of the Invention

The present invention relates to a "rigid shell" type of sport boot which closes and opens, at least on the top of the boot, by means of relatively flexible transverse flaps that partially overlap one another.

2. Background and Material Information

Sport boots of this type, such as the ski boots described in the Patent Applications FR 2 129 074, U.S. Pat. Nos. 4,974,346, 5,295,316, and the Japanese design patent H03-17685, for example, have a shell base which surrounds the wearer's foot and an upper which maintains the lower part of the wearer's leg, and tightening and/or closing devices associated with these portions of the boot ensuring the adjustment on the foot and the lower part of the leg. In these boots, the upper, whether it is made in one or more portions, covers vertical extensions extending from the shell base up to the area corresponding to the wearer's ankle. These vertical extensions are adapted to guarantee a certain sealing between the shell base and the upper, to allow for an adjustment and a differentiated tightening between these constituent portions of the boot, to distribute over a certain area the forces exerted locally by the tightening devices and, possibly, to facilitate the passage of the foot during the fitting and removal of the boot. To this end, the shell base is open longitudinally on the top and is provided with at least one pair of transverse flaps which overlap one another and extend its lateral walls on the top of the foot up to the ankle zone where they constitute, in part, its vertical extensions. As taught, the adjustment of these boots on the foot and the lower part of the leg occurs by reducing the volume of the upper and of the shell base by means of the tightening devices located outside. More particularly, in the case of the shell base, this volume reduction is obtained by causing the transverse flaps to come closer to one another. These flaps are, by deformation, lowered and tightened more or less toward the foot, depending on the force exerted by the tightening devices, while concurrently causing the at least partial deformation, in the same direction, of the lateral walls of the shell base from which they extend. This way of performing the adjustment and tightening of the boot on the foot has the advantage of allowing an excellent holding, because the internal volume of the shell base is really adapted to the external volume of the foot, with precision, by preferably using known tightening devices that are provided with a micrometric adjustment. However, because of the superimposition of the flaps, a relatively substantial increase in the pressure applied therebetween occurs in the area where they overlap, and thereby an increase in their transverse rigidity that is pronounced more especially as they are curved on the foot and in the zone corresponding to the flexion fold where they form the equivalent of half a tube bent approximately at 90°, as is the case in the boots of the documents FR 2 129 074, U.S. Pat. No. 5,295,316 and JP H03-17685 cited hereinabove.

However, it is precisely in this zone corresponding to the flexion fold that is necessary to provide a maximum of flexibility to obtain an optimum adjustment of the enveloping of the flaps above the instep, to not influence the bending characteristics of the upper with respect to the shell base, and to allow for a differentiated tightening between these constituent portions of the boot. It is obvious that it is also in this zone that is necessary to be capable of widely spacing the flaps to introduce or remove the foot in the case of a conventional boot of the "front entry" type, such as that described in the document FR 2 129 074. A partial solution to these problems is described in the U.S. Pat. No. 4,974,346. Indeed, according to this document, the sport boot, which includes an upper covering vertical extensions extending from the shell base in the zone corresponding to the ankle, has a shell base opened longitudinally on the top and provided in the area where it opens with two pairs of transverse flaps which extend its lateral walls and overlap one another. It is characterized, among others, in that the shell base has on the front, in the flexion fold zone, a transversely open slit which separates the lower portion surrounding the foot from the upper portion extending partially on the lower part of the leg, on the one hand, and that tongues are attached on the lower flaps to serve as a joint for the slit, on the other hand. With these arrangements, the upper can be tightened independently of the shell base while preserving the sealing in these portions of the boot. However, as a result, the superimposition of the front vertical extensions extending from the lateral walls of the shell base with those of the sealing tongues constitutes a laminated structure that notably increases the rigidity of the shell base in the zone corresponding to the flexion fold, which hinders and influences the bending of the upper with respect to the shell base. Furthermore, the provision of the transverse slit does not exempt from having to widely space the front vertical extensions which extend the lateral walls of the shell base, as well as the sealing tongues, for passage of the foot during fitting and removal of the boot. Finally, because of the addition of the sealing tongues in the slit on the transverse flaps, the solution taught by this document turns out to be of a certain complexity that burdens the production costs.

SUMMARY OF THE INVENTION

The present invention proposes to remedy these various problems with a simple and efficient solution which makes it possible to:

- preserve a proper sealing between the upper and the shell base;
- differentiate the tightening between the upper and the shell base;
- adjust precisely the enveloping of the foot in the flexion fold zone;
- not influence the bending characteristics of the upper with respect to the shell base;
- facilitate the passage of the foot during fitting and removal of the boot;
- make it particularly easy and simple to manufacture and use; and
- not burden the manufacturing costs.

To achieve these objectives, the rigid shell type of sport boot according to the invention includes an upper that covers vertical extensions extending from the shell base, in the zone corresponding to the wearer's ankle, and the shell base, made with a longitudinal opening on the top, is provided with at least one pair of transverse flaps which extend its lateral walls and overlap one another. The boot is characterized in that the flaps are each partially separated from the vertical and lateral extensions coming from the shell base by a slit that opens upwardly and is oriented substantially parallel to the longitudinal opening on the top of the shell base. The slits thus determine, in the front portion of the vertical extensions of the shell base, a generally U-shaped scallop short of transverse flaps extending the vertical lateral extensions of the shell base and a tongue on each flap, respectively. Therefore, the tongues obtained overlap one another naturally since they constitute the extension of the flaps and close the U-shaped scallop, while preserving a proper sealing between the upper and the shell base. As a result of this construction, the tightening of the upper on the lower part of the wearer's leg brings closer together the edges of the scallop which are located in the ankle zone, without pulling the tongues which are affixed to flaps at a level that is approximately in correspondence with the flexion fold, i.e., outside of the portions covered by the upper. This construction therefore makes it possible to differentiate the tightening between the upper and the shell base. Furthermore, because of the fact that the tongues are in simple superimposition with respect to one another and on the edges of the scallop, and that they are no longer connected to the vertical and lateral extensions of the shell base but merely to the flaps and on a narrow, and therefore slightly curved portion thereof, the pressure applied by the tightening devices associated with the shell base and/or with the upper does practically not increase their rigidity, and therefore their resistance upon bending of the upper with respect to the shell base. The initial and/or pre-adjusted bending characteristics of the upper with respect to the shell base are therefore not disturbed and/or influenced by the tightening forces applied on the tongues. Likewise, because of their linkage on a narrow portion of the flaps, the tongues are provided with a substantial flexibility with respect to the flaps, and therefore can be adjusted with precision in the flexion fold zone, thus ensuring an optimum enveloping of the opposite portion of the foot. As a result, it is obvious that the flexibility of the tongues thus obtained and the location thereof in the front zone of the scalloped shell base, at the level of the flexion fold, greatly facilitate the passage of the foot during fitting and removal of the boot.

Finally, by obtaining the tongues directly in the extension of the flaps that extend on the top of the shell base, and by providing their location in a scallop limited by the lateral vertical extensions of the shell base, it is possible to make them simultaneously with the molding of the shell base. Mounting operations that burden the manufacturing costs are thus avoided. Advantageously, the tongues obtained in the extension of the flaps are provided to have a certain width enabling the overlapping of the edges of the U-shaped scallop formed in the front portion of the vertical extensions of the shell base.

BRIEF DESCRIPTION OF DRAWINGS

The invention will be better understood along the description that follows, with reference to the annexed schematic drawings showing, by way of example, an embodiment of the sport boot, and in which.

DETAILED DESCRIPTION OF THE PREFERRED EMBODIMENTS

Figure 1:
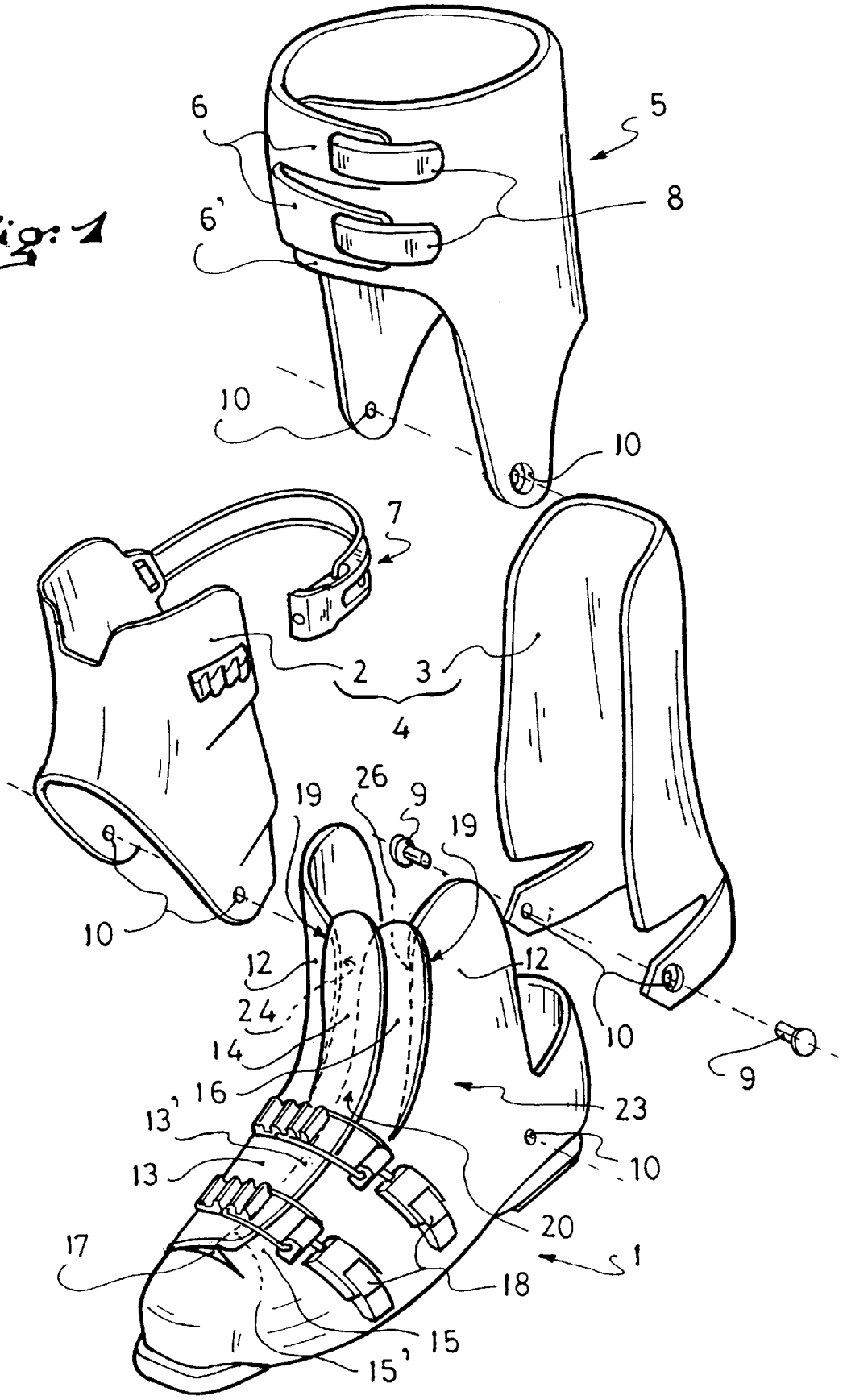
FIG. 1 is a perspective view of the shell base of a sport boot according to the invention with, optionally, an upper of the "rear entry" type, or an upper-collar of the "front-entry" type.
Figure 2:
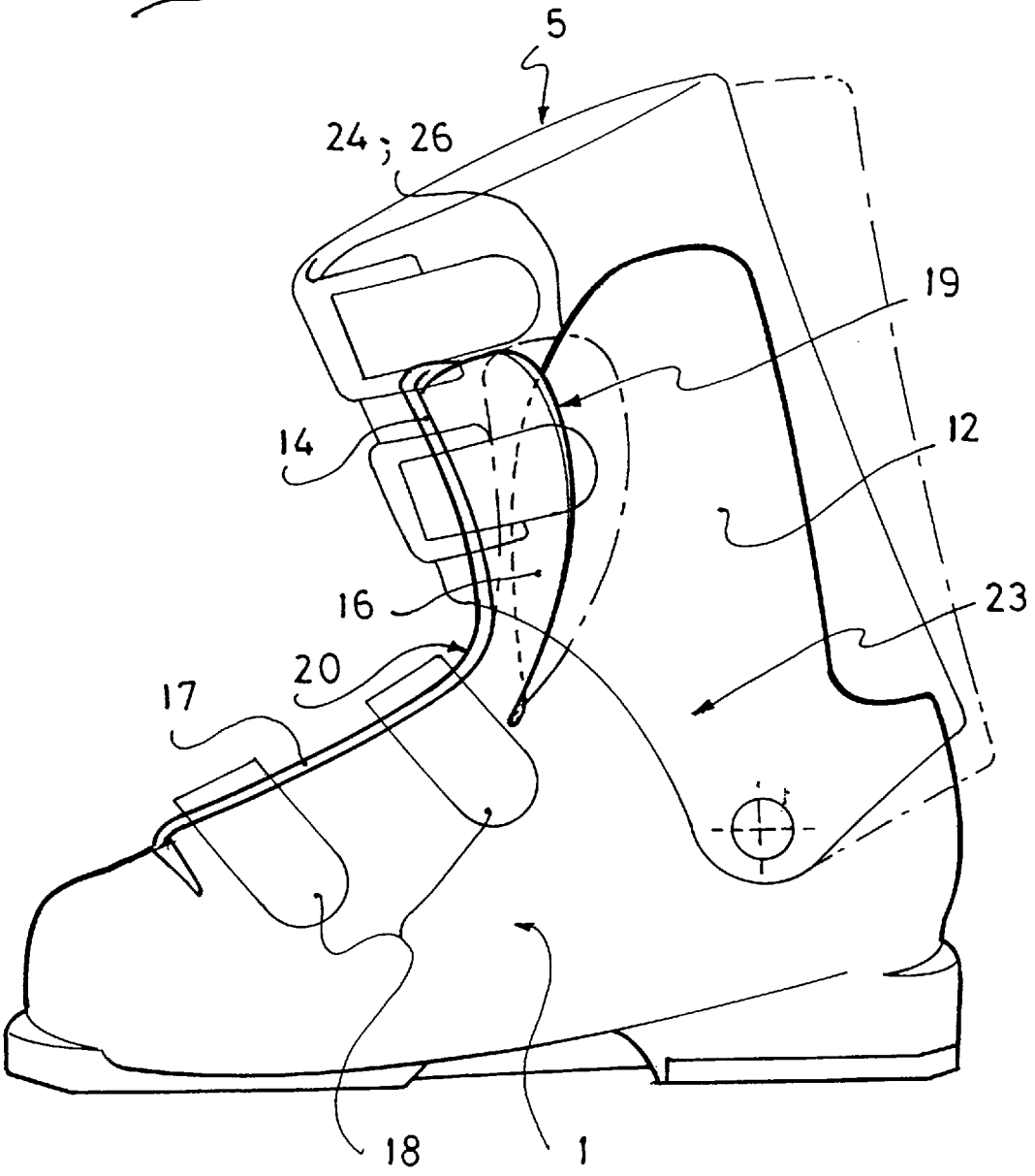
FIG. 2 is an elevated and lateral view of the shell base of the boot according to FIG. 1, provided with an upper-collar shown in dotted-lines, and shows the behavior of the tongues during a forward bending of the upper-collar.
Figure 3:
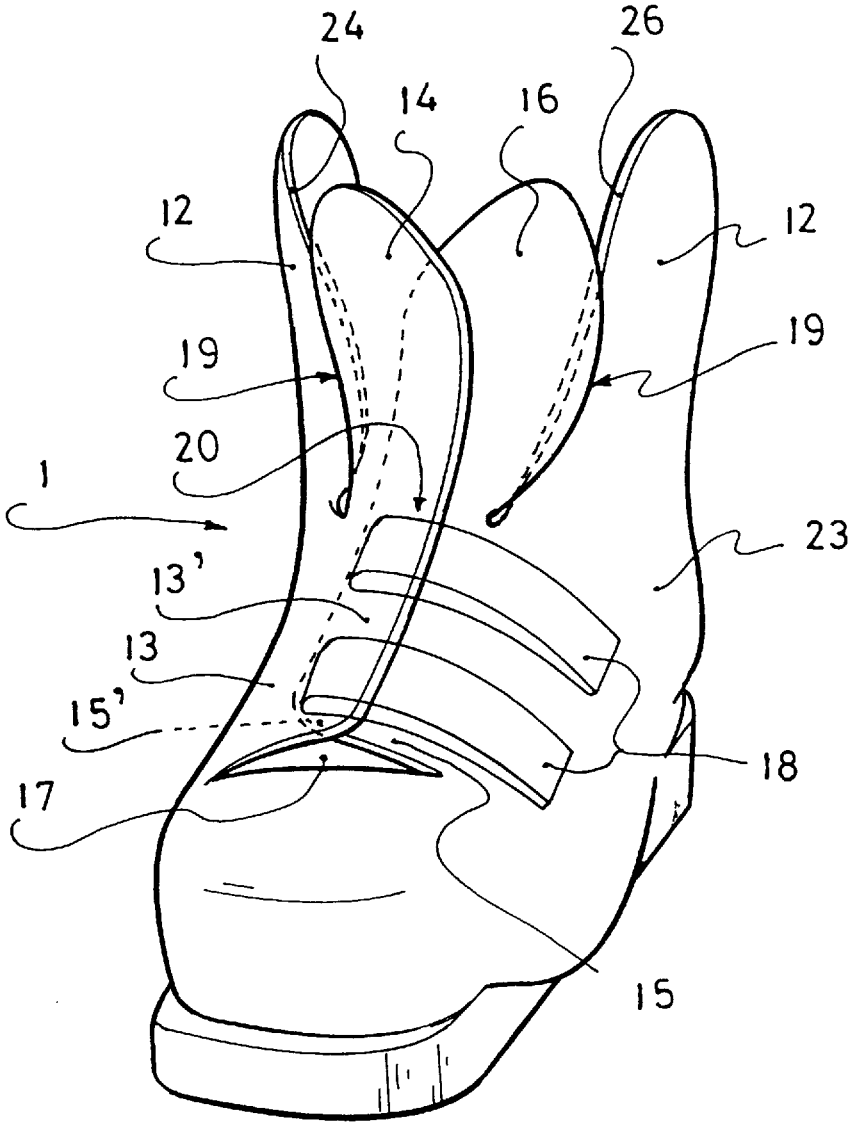
FIG. 3 illustrates a ¾ front perspective view of the shell base of the boot of FIG. 1, with its tongues covering the scallop obtained on its front portion.

The sport boot shown in FIG. 1 includes a shell base 1 and, optionally, an upper 4 of the "rear entry" type constituted by a closure cuff 2 and rear spoiler 3 provided that are with a tightening device 7, or an upper-collar 5 of the "front entry" type having closure transverse flaps 6, 6', with which tightening devices 8 are associated. The uppers 4 or 5 are pivotally connected to the shell base 1 by means of assembly means 9 such as rivets cooperating with corresponding holes 10 provided on the uppers 4 or 5 and the shell base 1, on the flanks of these constituent portions of the boot. The shell base 1, shown in FIGS. 1–3, is provided with lateral 12 and front 14 and 16 vertical extensions that extend its walls in the zone 23 corresponding to the wearer's ankle (not shown), and which are adapted to be covered, at least partially, by the upper 4 or 5. Furthermore, the shell base 1 includes, on the top, a longitudinal opening 17 closed by a pair of transverse flaps 13, 15 that overlap one another. These flaps 13, 15, are provided with tightening devices 18 that are capable of bringing them closer together to ensure the retention of the wearer's foot in the shell base 1 through reduction of the volume thereof. With these various arrangements, the upper 4 or 5 can be tightened on the lower part of the wearer's leg (not shown) by means of the tightening devices 7 or 8 independently of the tightening of the foot performed on the shell base 1 with the tightening devices 18, and while preserving a certain sealing between the shell base 1 and the upper 4 or 5, due to the vertical extensions 12, 14, 16. According to one particular characteristic, the front vertical extensions 14 and 16 extend from and are continuous with the transverse flaps 13 and 15 of the shell base 1, and are separated from the lateral vertical extensions 12 by slits 19 that open upwardly and are oriented substantially parallel to the longitudinal opening 17 provided on the top of the shell base 1. The slits 19 thus determine the edges 24, 26, of a forwardly facing U-shaped scallop in the front portion of the vertical extensions 12 of the shell base 1, and the front vertical extensions 14 and 16 constitute tongues. These extensions or tongues 14, 16, are thus naturally in a partial overlapping relationship since they are in the extensions of the narrow portions 13', 15', of the flaps 13, 15, that overlap one another. In fact, as can be seen in FIGS. 1 and 3, the front extension 14 has a continuous common edge with flap 13 and the front extension 16 has a continuous common edge with flap 15, these edges extending through the entire lengths of the flaps and the front extensions, i.e., from a front end of the flaps, through an area of the shell 1 base corresponding to a flexion fold of a wearer's foot, to an area above the flexion fold. Preferably, the slits 19 extend from the top down to approximately the zone 20 in correspondence with the flexion fold, in order to ensure an optimum enveloping of the opposite portion of the foot during use of the tightening device 18 located in the same zone 20, and in order to facilitate the passage of the foot during the fitting and removal of the boot, especially in the case of a boot having an upper-collar of the "front entry" type. Indeed, in this example of boot, it is no longer necessary to widely space the transverse flaps 13, 15, because the mere forward rocking of their tongues 14, 16, clears the flexion fold zone 20 and the U-shaped scallop through which the protuberance of the wearer's instep passes.

Advantageously, the tongues 14, 16, are provided to have a certain width enabling the overlapping of the edges 24, 26, of the U-shaped scallop, which improves the lateral sealing and prevents the risk of "side by side" abutment between the tongues and the scallop when the closure of the upper 4 or 5 on the lower part of the wearer's leg tends to tighten the lateral vertical extensions 12.

It is to be understood that any sealing means can be inserted between the transverse flaps 13, 15, the tongues 14, 16, and/or between the tongues 14, 16, and the edges 24, 26, of the scallop.

For example, flexible sealing lips can be used, whether they are attached or molded in one piece with either of the portions between which they are inserted, i.e., the flaps, the tongues or the lateral vertical extensions 12.

The instant application is based upon French Patent Application No. 96.05479, filed on Apr. 26, 1996, the disclosure of which is hereby expressly incorporated by reference thereto, and the priority of which is hereby claimed under 35 U.S.C. §119.

What is claimed:

1. A sport boot comprising:

a shell base including a pair of opposed upwardly extending lateral extensions extending upwardly from respective portions of the shell base, said portions corresponding to a wearer's ankle;

an upper attached to said shell base and overlapping said lateral extensions of said shell base;

said shell base including a pair of lateral walls and an upper longitudinally extending opening;

said shell base further including at least one pair of transverse flaps, each of said one pair of transverse flaps transversely extending from a respective one of said pair of lateral walls, said transverse flaps overlapping and closing said longitudinally extending opening of said shell base;

each of said transverse flaps is at least partially separated from a respective one of said pair of upwardly extending lateral extensions by a respective slit opening upwardly and oriented substantially parallel to said upper longitudinally extending opening of said shell base.

2. A sport boot according to claim 1, wherein:

said shell base further comprises a pair of upwardly extending front extensions continuous with and extending upwardly from respective ones of said transverse flaps; and forward of said lateral extensions, said shell base further comprises a generally U-shaped forwardly facing scallop, said scallop being defined at least in part by a pair of upwardly extending edges, each of said edges being defined by a respective one of said slits.

3. A sport boot according to claim 2, wherein:

said front extensions have lower ends extending continuously from rearward ends of said flaps in an area approximately corresponding to a flexion fold of the wearer's foot, below and not covered by said upper.

4. A sport boot according to claim 2, wherein:

said front extensions are in an overlapping relationship and have a width greater than a width of said scallop, whereby said overlapping front extensions cover said scallop.

5. A sport boot comprising:

a shell base having lateral walls and including a pair of opposed upwardly extending lateral extensions extending upwardly from respective portions of said lateral walls, said respective portions of said lateral walls corresponding to a wearer's ankle;

an upper attached to said shell base and overlapping said lateral extensions of said shell base;

said shell base including an upper longitudinally extending opening having a forward end at a front portion of said shell base;

said shell base further including at least one pair of flaps, each of said one pair of flaps transversely extending from a respective one of said pair of lateral walls, said flaps overlapping said longitudinally extending opening of said shell base, said flaps having front ends at said front end of said longitudinally extending opening;

each of said pair of transverse flaps is extended rearwardly by a respective front extension of said shell base, each of said transverse flaps and a respective one of said front extensions having a continuous common edge, each of said common edges extending from said front portion of said shell base, continuously longitudinally through an area of said shell base corresponding to a flexion fold of a wearer's foot, to an area above the flexion fold.

6. A sport boot according to claim 5, wherein:

said front extensions extend said transverse flaps at the flexion fold area, said flexion fold area not being covered by said upper.

7. A sport boot according to claim 5, wherein:

said transverse flaps are in an overlapping relationship and said front extensions are in an overlapping relationship.

8. A sport boot according to claim 5, wherein:

said upper comprises a collar having tightening devices for tightening said collar.

9. A sport boot according to claim 5, wherein:

said upper comprises a closure cuff and a rear spoiler.

* * * * *